US010107054B2

(12) United States Patent
Drury et al.

(10) Patent No.: US 10,107,054 B2
(45) **Date of Patent: *Oct. 23, 2018**

(54) POWER CHARGE HAVING A COMBUSTIBLE SLEEVE

(71) Applicant: DIAMONDBACK Industries, Inc., Crowley, TX (US)

(72) Inventors: Derrek D Drury, Fort Worth, TX (US); Jimmy L Carr, Fort Woth, TX (US); Robert C Andres, Fort Worth, TX (US); Trea H Baker, Granbury, TX (US)

(73) Assignee: DIAMONDBACK Industries, Inc., Crowley, TX (US)

( * ) Notice: Subject to any disclaimer, the term of this patent is extended or adjusted under 35 U.S.C. 154(b) by 226 days.

This patent is subject to a terminal disclaimer.

(21) Appl. No.: 14/467,718

(22) Filed: Aug. 25, 2014

(65) Prior Publication Data

US 2016/0053560 A1 Feb. 25, 2016

(51) Int. Cl.

| | |
|---|---|
| ***E21B 23/06*** | (2006.01) |
| ***F42B 3/04*** | (2006.01) |
| ***F42B 3/26*** | (2006.01) |
| ***F42B 5/192*** | (2006.01) |

(52) U.S. Cl.

CPC ..... *E21B 23/065* (2013.01); *F42B 3/04* (2013.01); *F42B 3/26* (2013.01); *F42B 5/192* (2013.01)

(58) Field of Classification Search

CPC ..... F42B 5/192; E21B 23/065
USPC ..... 102/200, 202, 202.14, 431; 166/63
See application file for complete search history.

(56) References Cited

U.S. PATENT DOCUMENTS

| | | | | |
|---|---|---|---|---|
| 2,618,343 | A | 11/1952 | Conrad | |
| 2,637,402 | A | 5/1953 | Baker et al. | |
| 2,640,547 | A | 6/1953 | Baker et al. | |
| 2,696,259 | A * | 12/1954 | Greene | E21B 33/127 166/179 |
| 2,848,194 | A * | 8/1958 | Porter | E21B 49/04 102/306 |
| 3,266,575 | A * | 8/1966 | Owen | E21B 23/065 166/120 |
| 4,649,827 | A * | 3/1987 | Brasquies | C06B 45/12 102/431 |
| 6,422,148 | B1 * | 7/2002 | Xu | E21B 43/117 102/307 |
| 9,453,382 | B2 * | 9/2016 | Carr | F42B 3/04 |
| 2007/0277694 | A1 * | 12/2007 | Wanninger | C06B 23/04 102/430 |

(Continued)

*Primary Examiner* — Reginald Tillman, Jr.
(74) *Attorney, Agent, or Firm* — Mark W Handley; Handley Law Firm, PLLC

(57) ABSTRACT

A power charge (12) for a downhole setting tool has a sleeve (14) which defines a housing. A propellant (16) is located in the sleeve (14) in solid form and defines a first end face (20). An igniter (32) is embedded into the propellant (16) first end face (20). The igniter (32) has a main body portion (52) with an end located adjacent to the first end face (20), and an annular-shaped protrusion (48) which extends laterally outward from the main body portion (52) and into the propellant (16). The annular-shaped protrusion (48) defines a shoulder (46) which engages the propellant (16) to retain the igniter (32) within the propellant (16) at the first end face (20) of the power charge (12). The sleeve (14) is formed of a combustible material which will burn when the propellant (16) is burned.

19 Claims, 1 Drawing Sheet

(56) References Cited

U.S. PATENT DOCUMENTS

2011/0174185 A1* 7/2011 Epstein ..... F42B 5/188
102/431

* cited by examiner

POWER CHARGE HAVING A COMBUSTIBLE SLEEVE

TECHNICAL FIELD OF THE INVENTION

The present invention relates in general to downhole oil tools, and more particularly to power charges for used for operating down hole oil tools.

CROSS-REFERENCE TO RELATED APPLICATION

The present application is related to U.S. patent application Ser. No. 14/467,803, entitled "Power Charge Ignitor Having a Retainer Protrusion," filed 25 Aug. 2014, and invented by Jimmy L. Carr, Derrek D. Drury, Robert C. Andres, and Trea H. Baker, inventors of the present application, and assigned to Diamondback Industries, Inc., the assignee of the present application.

BACKGROUND OF THE INVENTION

Power charges or power cartridges are used in oil and gas well setting tools for igniting and burning to power the setting of downhole tools such as plugs, packers, cement retainers, and other devices in well casing. Power charges are constructed of propellant mixtures composed of carefully controlled combustible elements containing an oxidizer which when ignited will begin a slow burn lasting approximately thirty seconds. The gas derived from a burning power charge propellant mixture gradually builds up to high pressures and causes a setting tool to stroke, setting a downhole tool in a well. In conventional setting tools, the power charge is placed in a power charge chamber which also provides a combustion chamber. The power charge is burned and typically creates gas pressure from 7,000 psi to 13,000 psi. Typical prior art power charges were made by packing the propellant into a sleeve formed of plastic, fiberglass or steel. Some prior at power charges have a first end which is open and which exposes the combustible material to an igniter. Other power charges have an igniter embedded in the first end of the power charge.

Problems have been encountered when the fiber glass and the plastic sleeves are used as power charge housings. Burning the power charges will often create plastic debris which has blocked flow ports and caused the setting tools to fail to operate properly. Also, partially melted plastic residue will often line the sidewalls of the setting tool power charge combustion chamber and can be difficult to clean from the sidewalls. Steel tubes have also been used for power charge housings, but these also have difficulty. The steel tubes can deform when the flammable mixture of the power charge burns and be difficult to remove from power charge chambers of setting tools. Additionally, steel tubes, plastic tubes and fiberglass tubes can contain the gasses of the power charge mixture as is burns until high pressures build up within the housing, which can lead to an explosive discharge and the tubes being ejected as a projectile from a burning fire. This has resulted in the Department of Transportation to classifying power charges as explosives when the power charges have outer housings provided by steel tubes, fiberglass tubes, and plastic tubes.

Some prior art power charges have an igniter located in one end, embedded in the propellant. Prior art power charges are typically cylindrical. Shipping and handling, variations in temperature, and shrinkage of propellant mixtures with variations in humidity can cause the igniter to become loose in the propellant mixture, with some having completely fallen out of the power charge housing. Although the power charge igniter may be pushed back into the propellant mixture by hand, the igniter will remain susceptible to being jostled and disconnecting from with the power charge propellant material. This condition is not acceptable.

SUMMARY OF THE INVENTION

A power charge is disclosed for burning in a setting tool to power the setting of a downhole tool. The power charge has a combustible sleeve which is cylindrically-shaped and which defines an external housing for the power charge. A propellant is packed into the combustible sleeve to define a first end face. An igniter is disposed in the first end face, embedded into the propellant. The igniter has a main body portion which is cylindrically-shaped and disposed adjacent to the first end face of the power charge, and an annular-shaped protrusion extending laterally outward from the main body portion and into the propellant. The annular-shaped protrusion defines a shoulder which extends from the main body portion, spaced apart from the end face of the power charge, and engages the propellant to retain the igniter within the propellant in the first end face of the power charge. The combustible sleeve is formed of a combustible material, such that the sleeve will burn when the propellant is burned. This allows the remaining post burn residue of the combustible sleeve to be easily cleaned from the combustion chamber of the setting tool, allowing for easy cleanup and decreasing the redress time for the setting tool.

DESCRIPTION OF THE DRAWINGS

For a more complete understanding of the present invention and the advantages thereof, reference is now made to the following description taken in conjunction with the accompanying Drawings in which

FIG. 1 is a longitudinal section view of the power charge having the combustible sleeve;

FIG. 2 is a first end view of the power charge;

FIG. 3 is a second end view of the power charge; and

FIG. 4 is longitudinal section view of an igniter for use in the power charge, taken along section line 1-1 of FIG. 2.

DETAILED DESCRIPTION OF THE INVENTION

Figure 1:
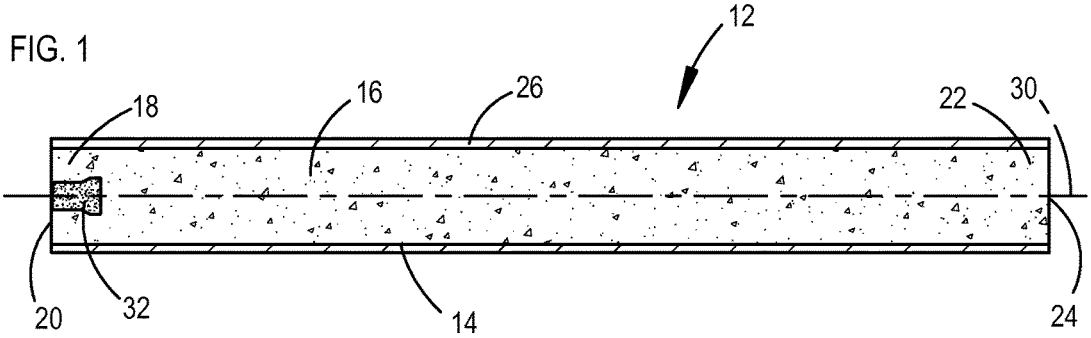
FIGS. 1 through 4 show various aspects for a power charge having an exterior housing provided by a combustible sleeve according to the present invention, as set forth below.
Figure 2:
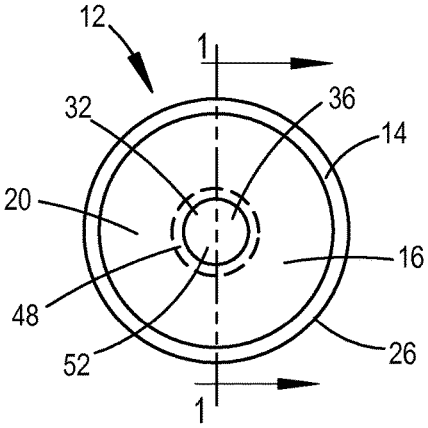

Referring to the Figures, FIG. 1 is a longitudinal section view of a power charge 12, taken along section line 1-1 of FIG. 2. The power charge 12 has a combustible sleeve 14 which provides an exterior housing. A propellant 16 is located within the sleeve 14, such that preferably the propellant 16 is self retained within the sleeve 14. The propellant 16 is formed of a mixture of elements which provide a controlled burn rate when ignited, such as a burn rate lasting approximately thirty seconds. Preferably, the propellant 16 is a mixture of combustible components, an oxidizer, and an epoxy binder. Applicant's present propellant 16 for power charges 12 is typically a mixture including sodium nitrate, Pyrodex, which is a smokeless black powder substitute, wheat flour, and a two part epoxy composed of an epoxy resin and an epoxy hardener. The mixture is preferably mixed to a dough-like form, of a consistency similar to cookie dough, which is preferably tightly packed into the sleeve 14 to form a continuous mass of propellant which fully fills the sleeve 14. A slow cure epoxy is preferably used as a binder which will harden to a solid in twenty-four hours, locking the propellant 16 into the sleeve 14.

The sleeve 14 preferably has a first end 18 and a second end 22, each having open end faces 20 and 24, respectively. The sleeve 14 preferably has a cylindrical shaped periphery 26, defining a lateral periphery providing the exterior surface for the continuous side of the power charge 12. An igniter 32 is preferably embedded in the propellant 16 located in the first end 18 of the power charge 12, prior to curing of the epoxy binder in the propellant mixture 16. The igniter 32 is preferably centered in the end face 20 and exposed to the exterior of the power charge 12, with both the sleeve 14 and the igniter 32 preferably being concentrically disposed about a central longitudinal axis 30. The sleeve 14 is preferably formed of a paper type fiberboard material which will readily burn when the power charge propellant 16 is burned. Other materials may also be used to provide the sleeve 14, such as card board, paper, and the like, and other materials which will readily burn when exposed to the burning propellant 16. The sleeve 14 is preferably formed around a mandrel using three to four layers of a sheet of fiberboard material, wound to a total wall thickness of 0.030 inches to 0.060 inches. In other embodiments, larger wall thickness may be provided, such as more than one-quarter inch thick. Preferably, the sleeves 14 are provided by fiberboard tubes formed of cardboard sheets wound to three or four layers, forming a three ply or four ply tube structure. A spray adhesive is used between each ply, preferably using polyvinyl alcohol (PVOH).

Power charges made according to the present invention can be of various sizes, ranging from three-quarter inch diameter to 3 inches, with lengths from eight inches to thirty-eight inches. The largest power charge the applicant currently offers is for a two and eleven-sixteenth tool, and has eight hundred grams of propellant, is eighteen inches long, and has a diameter of two and one-eight inches. The smallest power charge the applicant currently offers is for a No. 10 setting tool, and has three hundred and sixty grams of propellant, is twelve inches long, and has a diameter of 1.3 inches. The applicant also currently provides a power charge for a No. 20 setting tool, which has four hundred and sixty grams of propellant, is 11.4 inches long, and has a diameter of 1.5 inches.

Figure 3:
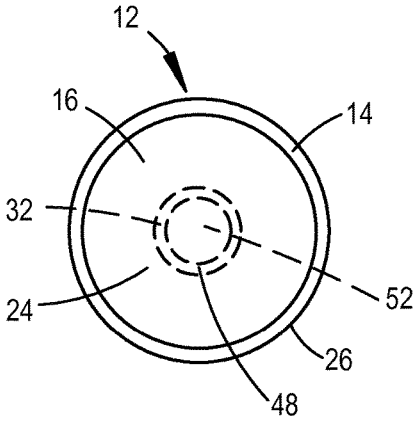

FIG. 2 is a first end view of the power charge 12 showing the first end face 20, and FIG. 3 is a second end view of the power charge 12 showing the second end face 24. An end face 36 of the igniter 32 is shown as preferably being centered in the end face 20 of the power charge 12. The end face 36 of the igniter 32 is preferably exposed at the first end 18 of the power charge 21, allowing one or more electrical contact pins of a firing head to directly contact the igniter 32. The igniter can be seen having an annular-shaped protrusion 48 for retaining the igniter 32 within the propellant 16 packed into the sleeve 14. The igniter is preferably formed of an ignition materials 34 which includes sixty to seventy percent Pyrodex, which is a smokeless black powder substitute, ten percent potassium nitrate, three percent graphite, carbon black, and a binder, which are packed together with the binder to form a rigid unit.

Figure 4:
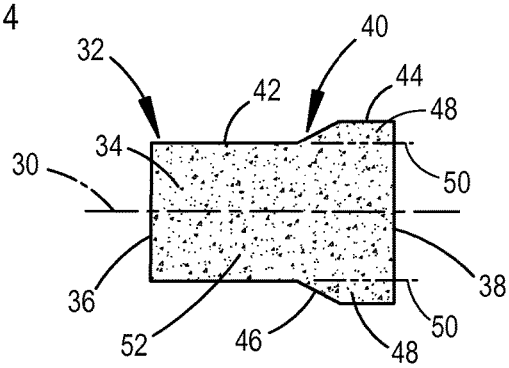

FIG. 4 is longitudinal section view of the igniter 32 for use in the power charge 12, taken along section line 1-1 of FIG. 2. The igniter 32 has a first end defining the outward end face 36, a second end defining an inward end face 38, and an external periphery 40. The periphery 40 has a first portion 42 which is preferably cylindrical in shape, a second portion 44 which is also preferably cylindrically shaped, and an intermediate portion defining an annularly extending, frusto-conical shaped shoulder 46 which extends between the first portion 42 and the second portion 44. In this configuration for the igniter 32, the first portion 42 defines at least part of an outer periphery for a main body portion 52 of the igniter 32. The second portion 44 is of a larger size than the first portion 42, such that an annular-shaped protrusion 48 extends laterally outward from projection lines 50. The projection lines 50 are preferably defined by a cylindrical projection from the outer periphery of the first portion 42.

The igniter 32 preferably has a main body portion 52, or a central core portion, defined by the first portion 42 of the outer periphery 40 and the projection lines 50 which extend from the first portion. The main body portion 52 does not include the annular-shaped protrusion 48, which is defined to extend between the second peripheral portion 44 of the outer periphery 40 and the projection line 50 extending from the first peripheral portion 42, parallel to the first peripheral portion 42. The opposite terminal ends of the annular-shaped protrusion 48 are defined by the tapered, frusto-conical shaped shoulder 46 and the outward portions of the inward face 38. The annular-shaped protrusion 48 provides a protrusion member which extends laterally outward, or in the case of cylindrically-shaped forms of the igniter 32 extends radially outward, from the main body portion 52 of the igniter 32. The tapered shoulder 46 of the protrusion 48 is spaced apart from the end face 20 of the power charge 12, preferably by a longitudinal length of the periphery 42 which extends parallel to the central axis 30, to provide a layer of the propellant 16 between the protrusion 48 and the end face 20 to retain the igniter within the propellant 16 and within the first end of the power charge 12.

In some embodiments, the annular-shaped protrusion 48 may not be continuos, but may instead be of a castellated with a plurality of radially extending projections. In other embodiments, a protrusion member may be provided by one or more radial projections extending in only one or in more radial directions from the central axis 30 of the main body portion 52. The shoulder 46 holds the igniter 32 in place within the power charge and provides a taper. The taper provided by the shoulder 46 has been found to cause the igniter flame to swirl around the main body 52, causing improved ignition of the propellant 16. Improved ignition of the propellant 16 provides for a cleaner burn. Other embodiments of the power charge 16 and the igniter 32 may be formed of various shapes. The power charge 16 and the igniter 32 need not be of a cylindrical external shapes, but instead may have cross-sectional shapes which are triangular, oval, square, hexagonal, and the like. Similarly, the outer shapes of the power charge 16 and the igniter 32 may be different from one another. The peripheral exterior shapes of the power charge 16 and the igniter 32 need not be continuous, and may also vary in shape from one end to another.

The present invention provides advantages of a combustible sleeve providing a housing for a power charge. The combustible sleeve is preferably formed of combustible materials, such as a paper based fiberboard tube. Other materials may be used to provide the combustible sleeve, such as card board, paper, and the like, and other materials which will readily burn when exposed to the burning propellant of the power charge. The power charge also includes an igniter embedded in the propellant material of the power charge, which has an laterally outward protruding, annular-shaped protrusion. The annular-shaped protrusion provides a projection which retains the igniter embedded in the propellant packed into the end of a power charge. The annular-shaped, tapered shoulder of the igniter causes the igniter flame to swirl around the main body of the power charge, causing improved ignition of the propellant for a more thorough burn.

Although the preferred embodiment has been described in detail, it should be understood that various changes, substitutions and alterations can be made therein without departing from the spirit and scope of the invention as defined by the appended claims.

What is claimed is:

1. A power charge for igniting in a downhole tool to provide high pressure gas for powering the downhole tool, the power charge comprising:

a sleeve defining a housing which at least in part provides a lateral periphery for the power charge;

a propellant disposed in said sleeve, said propellant including of a mixture of combustible components and an oxidizer for providing a controlled burn rate to power the downhole tool;

an igniter is disposed in a first end face of said power charge, embedded into said propellant; and wherein said sleeve is formed of a sheet of combustible material, such that said sleeve will ignite and burn when exposed to said propellant when burned, and said sheet of combustible material is wound about a mandrel to define said sleeve.

2. The power charge according to claim 1, wherein said power charge is cylindrically shaped.

3. The power charge according to claim 1, wherein said sheet of combustible material from which said sleeve is formed comprises a layer of fiberboard, and said layer of fiberboard is wound with an adhesive applied between each ply.

4. The power charge according to claim 1, wherein said sheet of combustible material from which said sleeve is formed comprises a layer of cardboard, and said layer of cardboard is wound with an adhesive applied between each ply.

5. The power charge according to claim 1, wherein said sheet of combustible material from which said sleeve is formed comprises at least one layer of paper, and said layer of paper is wound with an adhesive applied between each ply.

6. The power charge according to claim 5, wherein said at least one layer of paper provides said sleeve with a wall thickness of in the range of 0.008 inches to 0.025 inches.

7. A power charge for igniting in a downhole tool to provide high pressure gas for powering the downhole tool, the power charge comprising:

a sleeve which at least in part defines a housing for said power charge and a lateral periphery for an exterior of said power charge;

a propellant packed into said sleeve, said propellant including of a mixture of combustible components, an oxidizer and a binder for providing a controlled burn rate to power the downhole tool;

an igniter disposed in a first end face of said power charge, embedded into said propellant; and wherein said sleeve is formed of a combustible material, such that said sleeve will ignite and burn when exposed to said propellant when burned, and said combustible material is wound about a mandrel to define said sleeve, with said sleeve having a first end and a second end.

8. The power charge according to claim 7, wherein said combustible material from which said sleeve is formed comprises a layer of fiberboard.

9. The power charge according to claim 7, wherein said combustible material from which said sleeve is formed comprises is a layer of cardboard.

10. The power charge according to claim 7, wherein said combustible material from which said sleeve is formed at least in part comprises a layer of paper.

11. The power charge according to claim 10, wherein said layer of paper provides said sleeve with a wall thickness of in the range of 0.030 inches to 0.060 inches.

12. The power charge according to claim 10, wherein said binder for said propellant comprises a two part epoxy.

13. A power charge for igniting in a downhole tool to provide high pressure gas for powering the downhole tool, the power charge comprising:

a sleeve which is cylindrically shaped and defines a housing which at least in part provides a cylindrically-shaped lateral periphery for the power charge;

a propellant packed into said sleeve to form a continuous mass filling said sleeve, and having a first terminal end which defines a first end face of said power charge;

said propellant including of a mixture of combustible components and an for providing a controlled burn rate to power the downhole tool, and said propellant further including a binder which cures to bind said propellant into a solid form;

an igniter disposed in said first end face of said power charge, embedded into said propellant with said propellant in said solid form; and wherein said sleeve is formed of a sheet of combustible material, such that said sleeve will ignite and burn when exposed to said propellant when burned, and said sheet of combustible material is wound into layers to define said sleeve, with said sleeve having a first end and a second end, and each of said first end and said second end having open end faces, respectively.

14. The power charge according to claim 13, wherein said sheet of combustible material comprises a layer fiberboard, and said layer of fiberboard is wound with an adhesive applied between each ply.

15. The power charge according to claim 13, wherein said sheet of combustible material comprises a layer of cardboard, and said layer of cardboard is wound with an adhesive applied between each ply.

16. The power charge according to claim 13, wherein said sheet of combustible material comprises at least one layer of paper, and said layer of paper is wound with an adhesive applied between each ply.

17. The power charge according to claim 16, wherein said at least one layer of paper provides said sleeve with a wall thickness of in the range of 0.030 inches to 0.060 inches.

18. The power charge according to claim 13, wherein an outward face of said igniter is substantially flush with said terminal end of said propellant which defines said first end face of said power charge.

19. The power charge according to claim 13, wherein said binder for said propellant comprises a two part epoxy.

* * * * *